US009655396B1

(12) United States Patent
Lacy

(10) Patent No.: US 9,655,396 B1
(45) Date of Patent: May 23, 2017

(54) WIND AND WATER HAT

(71) Applicant: SUNDAY AFTERNOONS, INC., Talent, OR (US)

(72) Inventor: Robbin J. Lacy, Talent, OR (US)

(73) Assignee: Sunday Afternoons, Inc., Talent, OR (US)

( * ) Notice: Subject to any disclaimer, the term of this patent is extended or adjusted under 35 U.S.C. 154(b) by 0 days.

(21) Appl. No.: 13/662,430

(22) Filed: Oct. 27, 2012

Related U.S. Application Data

(63) Continuation-in-part of application No. 12/319,446, filed on Jan. 7, 2009, now abandoned.

(51) Int. Cl.
*A42C 5/04* (2006.01)
*A42B 1/20* (2006.01)

(52) U.S. Cl.
CPC ..... *A42B 1/206* (2013.01)

(58) Field of Classification Search
CPC ..... A42B 1/002; A42B 1/201; A42B 1/206
USPC ..... 2/209.12, 175.1, 175.2, 175.4, 195.1, 2/195.5, 195.6, 184.5
See application file for complete search history.

(56) References Cited

U.S. PATENT DOCUMENTS 446,762 A * 2/1891 Tuch ..... 2/181
900,129 A * 10/1908 Stevens ..... 2/175.4
901,320 A * 10/1908 Bruzaud ..... A42B 1/247 2/10
1,236,984 A * 8/1917 Reiss ..... 2/175.4
1,330,299 A * 2/1920 Ballard ..... 2/195.7
2,663,024 A * 12/1953 Cantor ..... 2/175.5
4,096,590 A * 6/1978 Keshock ..... 2/175.5
4,999,851 A * 3/1991 Hall ..... 2/175.5
5,669,071 A * 9/1997 Vu ..... A42B 1/247 2/10
5,857,219 A * 1/1999 Edmark ..... 2/182.2
5,915,533 A * 6/1999 Halle ..... 2/175.5
5,950,241 A * 9/1999 Gomez ..... 2/172
6,088,837 A * 7/2000 Baker ..... 2/195.1
6,101,632 A * 8/2000 Veazey ..... 2/175.5
6,216,277 B1 * 4/2001 Cheng ..... 2/171.03
6,237,156 B1 * 5/2001 Ellman ..... A42B 1/064 2/10
6,256,794 B1 * 7/2001 Erickson ..... 2/209.11
6,260,204 B1 * 7/2001 Morrissey ..... 2/172
6,260,208 B1 * 7/2001 Wang ..... 2/209.11
6,561,393 B1 * 5/2003 Cheng ..... A42B 1/201 2/171.03
6,704,940 B1 * 3/2004 Convery ..... A42B 1/02 2/175.1
6,721,961 B2 * 4/2004 Park ..... A42B 1/063 2/175.2
6,735,782 B2 * 5/2004 Park ..... A42B 1/063 2/175.2
6,990,692 B1 * 1/2006 Park ..... A42C 5/00 2/175.5
7,137,146 B2 * 11/2006 Yan ..... A42B 1/066 2/12
D629,183 S * 12/2010 Adams ..... D2/882
(Continued)

*Primary Examiner* — Sally Haden
(74) *Attorney, Agent, or Firm* — McCoy Russell LLP

(57) ABSTRACT

A wind and water hat includes a hat body, a hat brim carried by the hat body and at least one generally flexible brim wire provided in the hat brim. The hat brim ratchets with respect to the brim wire or wires responsive to force applied to the hat brim.

19 Claims, 6 Drawing Sheets

(56) References Cited

U.S. PATENT DOCUMENTS

| | | | | |
|---|---|---|---|---|
| 8,516,618 | B2 * | 8/2013 | Adams | A42B 1/064 2/175.1 |
| D756,075 | S * | 5/2016 | Reinhart | D2/891 |
| 2003/0074716 | A1 * | 4/2003 | Park | A42B 1/063 2/175.1 |
| 2003/0172437 | A1 * | 9/2003 | Guerra | A42B 1/065 2/171 |
| 2004/0000004 | A1 * | 1/2004 | Wang | A42B 1/063 2/195.1 |
| 2004/0194192 | A1 * | 10/2004 | Cho | 2/195.1 |
| 2008/0098502 | A1 * | 5/2008 | Tai | 2/175.1 |
| 2012/0255100 | A1 * | 10/2012 | Smith | A42B 1/208 2/171.1 |
| 2014/0338097 | A1 * | 11/2014 | Kay | A42B 1/248 2/195.1 |
| 2015/0327613 | A1 * | 11/2015 | Kay | A42B 1/064 2/209.13 |
| 2016/0021959 | A1 * | 1/2016 | Song | A42B 1/062 2/195.1 |

* cited by examiner

WIND AND WATER HAT

CROSS-REFERENCE TO RELATED APPLICATIONS

This application claims priority to U.S. Ser. No. 12/319,446, entitled "Wind and Water Hat", filed Jan. 7, 2009, and is hereby incorporated herein for all purposes.

FIELD OF THE INVENTION

The present disclosure relates to hats. More particularly, the present disclosure relates to a wind and water hat having a hat brim which is capable of folding in a ratcheting, segmented or stepwise manner in response to wind, water, manipulation by a wearer or other external force.

BACKGROUND OF THE INVENTION

Hats typically include a hat body which fits on the head of the wearer and a brim which extends from a forward edge of the hat body. The brim may be a rigid or a semi-rigid material. Consequently, the brim may be substantially resistant to yielding when wind, water or other outside forces are applied to the brim. Therefore, the wind, water or other outside forces applied to the brim may cause the hat to inadvertently dislodge from the head of the wearer and become lost or irretrievable. Furthermore, the brim may fold or collapse under influence of outside forces, obscuring vision and negating the benefits of the formed brim.

Accordingly, a wind and water hat having a brim which is capable of folding in a ratcheting, segmented or stepwise manner in response to wind, water, manipulation by a wearer or other external force applied to the brim is needed. The brim may be fabricated with brim wires which serve to hold the form of the brim, which may otherwise lose its shape responsive to outside forces.

SUMMARY OF THE INVENTION

The present disclosure is generally directed to a wind and water hat having a hat brim which is capable of folding in a ratcheting, segmented or stepwise manner in response to wind, water, manipulation by a wearer or other external force. An illustrative embodiment of the wind and water hat includes a hat body, a hat brim carried by the hat body and at least one generally flexible brim wire provided in the hat brim. The hat brim ratchets with respect to the at least one brim wire responsive to force applied to the hat brim.

In an alternative illustrative embodiment, the wind water hat includes a hat body, a hat brim, initially deployed in a downwardly-sloped position, carried by the hat body, at least one generally flexible outer brim wire provided in the hat brim, at least one generally flexible inner brim wire provided in the hat brim in a spaced-apart relationship with respect to the outer brim wire, wherein the outer and inner brim wires are not connected to one another and operate independently of one another. The downwardly-sloped hat brim ratchets upwardly with respect to the outer and inner brim wires operating independently one from the other, responsive to force applied to the hat brim thus providing segmented or stepwise upward bending of the hat brim in the direction of the force being applied to the hat brim.

The present disclosure is further generally directed to a method of fabricating a wind and water hat having a hat brim which is capable of folding in a ratcheting, segmented or stepwise manner in response to wind, water, manipulation by a wearer or other external force. An illustrative embodiment of the method includes fabricating a hat brim by providing a brim substrate, providing at least one brim wire and attaching the at least one brim wire to the brim substrate; providing a hat body; and attaching the hat brim to the hat body.

BRIEF DESCRIPTION OF THE DRAWINGS

The disclosure will now be made, by way of example, with reference to the accompanying drawings, in which.

DETAILED DESCRIPTION OF THE INVENTION

Figure 1:
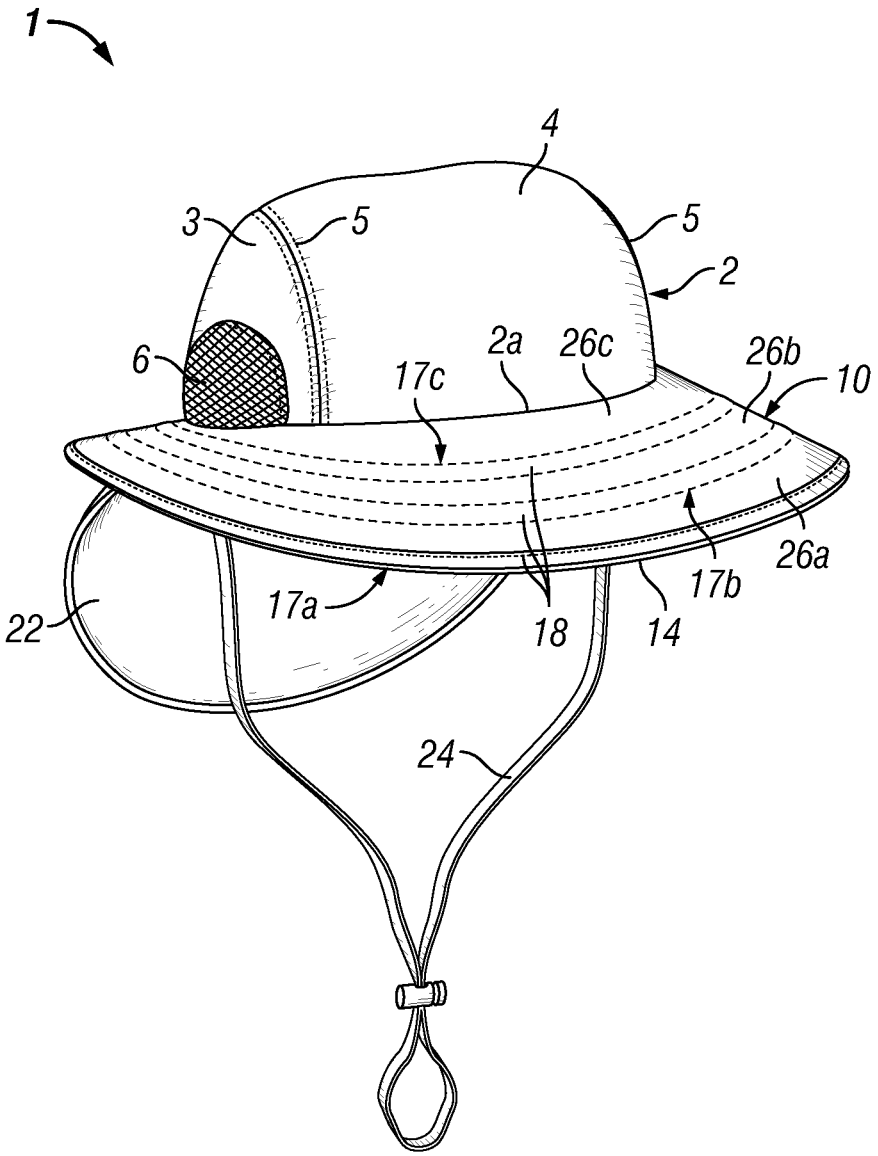
FIG. 1 is a front perspective view of an illustrative embodiment of the wind and water hat.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure which is defined by the claims. Furthermore, there is no intention to be bound by any expressed or implied theory presented in the preceding technical field, background, brief summary or the following detailed description.

Referring initially to FIGS. 1, 2, and 3-7A of the drawings, an illustrative embodiment of the wind and water hat is generally indicated by reference numeral 1. For purposes of illustration and not limitation, the wind and water hat 1 may include a hat body 2 which in some embodiments may have a pair of spaced-apart side portions 3 and a top portion 4 which extends between the side portions 3. A seam 5 may attach each side portion 3 to the top portion 4 of the hat body 2. In other embodiments, the hat body 2 may be a one-piece construction or may have any other construction which is known by those skilled in the art. In some embodiments, vent netting 6 may be provided in the hat body 2, such as in each side portion 3, for example and without limitation, for venting purposes. As illustrated in FIGS. 2-5, an adjustment strap 7 may be provided on the hat body 2 for securing the hat body 2 on the head (not illustrated) of a wearer. In some embodiments, the hat body 2 may be a cap, visor or full brimmed hat, for example and without limitation.

Figure 4:
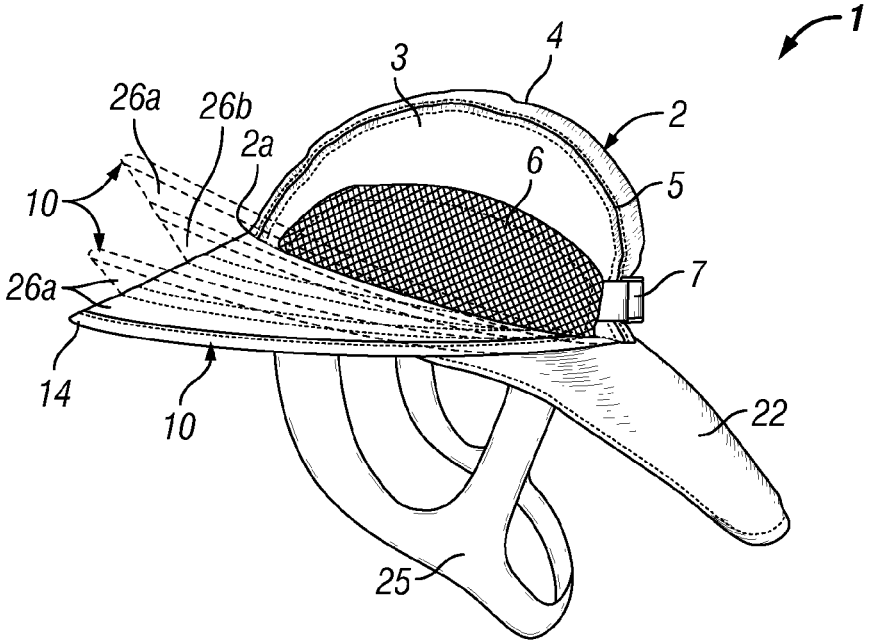
FIG. 4 is a left side view of an illustrative embodiment of the wind and water hat, fitted with a neck yoke, more particularly illustrating partial folding or ratcheting of the hat brim to various positions (illustrated in phantom) responsive to application of force to the hat brim.
Figure 5:
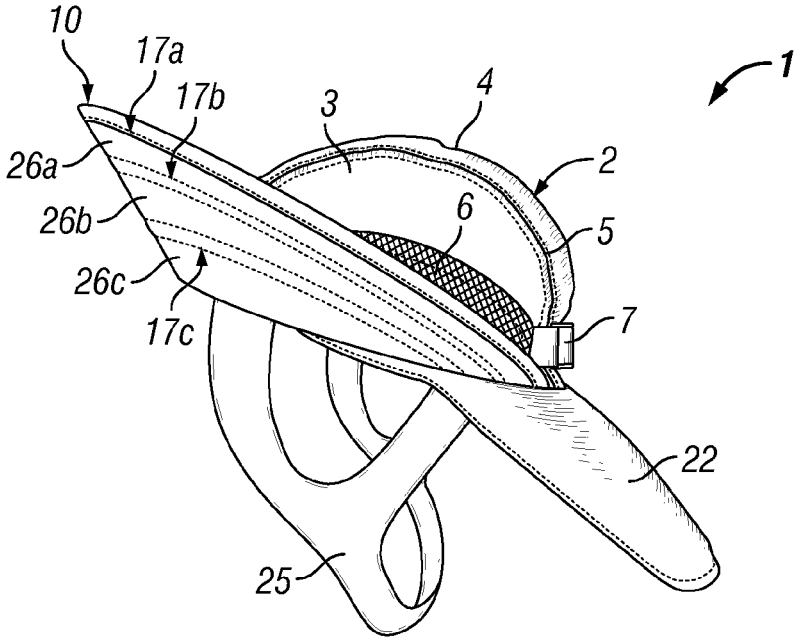
FIG. 5 is a left side view of an illustrative embodiment of the wind and water hat, fitted with a neck yoke, with the hat brim in a fully-folded position.

The hat body 2 of the wind and water hat 1 may have additional features. For example and without limitation, in some embodiments a flexible neck shield 22 may extend from a rear edge of the hat body 2 to cover and shield the neck (not illustrated) of a wearer from the sun. The neck shield 22 may be sewn and/or otherwise attached to the hat body 2. In some embodiments, an adjustable chin strap 24 may extend from the hat body 2 for extension around the chin (not illustrated) of the wearer to secure the wind and water hat 1 to the wearer's head. As illustrated in FIGS. 4 and 5, a neck yoke 25 may extend from the hat body 2 for extension around the chin of the wearer. The neck yoke 25 may be neoprene, for example and without limitation.

Figure 2:
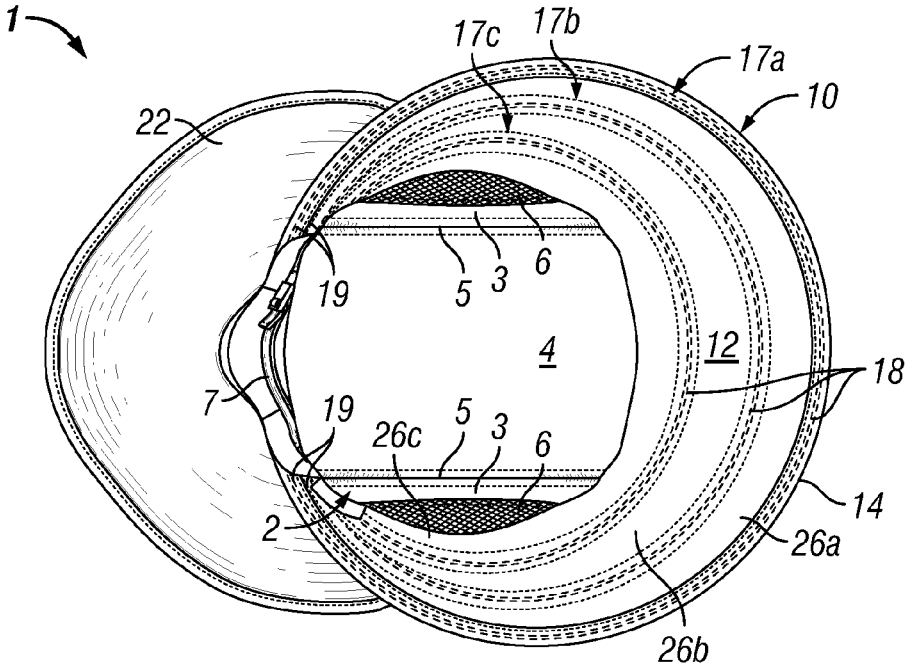
FIG. 2 is a bottom view of an illustrative embodiment of the wind and water hat of FIG. 1.

A flexible hat brim 10 having a rim 14 extends from the hat body 2 at a brim/hat body junction 2*a*. The hat brim 10 may be sewn and/or otherwise attached to the hat body 2 according to the knowledge of those skilled in the art. As will be hereinafter described, the hat brim 10 may be capable of bending in a segmented or stepwise manner responsive to application of an external force such as wind or water to the hat brim 10. The segmented or stepwise bending of the hat brim 10 may at least partially deflect the external force which is applied to the hat brim 10 and prevent the hat body 2 from being inadvertently dislodged from the head of the wearer. As illustrated in FIG. 2, in some embodiments the hat brim 2 may be generally crescent-shaped. In other embodiments, the hat brim 2 may have the general shape of a half-moon or may be generally circular, oblong or semi-circular in configuration, for example and without limitation.

Figure 3:
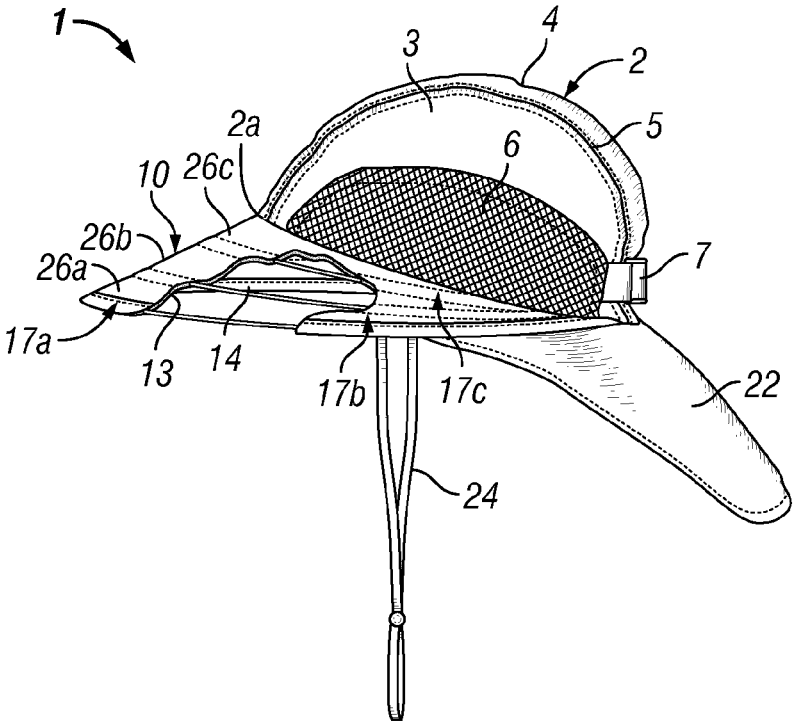
FIG. 3 is a left side view of an illustrative embodiment of the wind and water hat of FIG. 1.

As illustrated in FIGS. 1-3, at least one brim wire 17 is provided in the hat brim 10 between the rim 14 of the hat brim 10 and the brim/hat body junction 2*a*. The brim wire 17 divides the hat brim 10 into at least two brim sections 26. Each brim wire 17 may be a semi-flexible synthetic material such as polyester, polypropylene or nylon, for example and without limitation. In some embodiments, each brim wire 17 may have a diameter of from about 0.5 mm to about 2.5 mm. The brim wires 17 are positioned in the hat brim 10 in such a manner that the brim wires 17 hold the shape of the hat brim 10 until external forces (not illustrated) such as wind or rain, for example and without limitation, are applied against the hat brim 10.

In some embodiments of the wind and water hat 1, an outer brim wire 17*a*; a middle brim wire 17*b*; and an inner brim wire 17*c* are provided in the hat brim 10. The outer brim wire 17*a* may extend generally through or adjacent to the rim 14 of the hat brim 10. The middle brim wire 17*b* extends through the hat brim 10 in spaced-apart relationship with respect to the outer brim wire 17*a*. The inner brim wire 17*c* extends through the hat brim 10 in spaced-apart relationship with respect to the middle brim wire 17*b*. In some embodiments, an innermost brim wire (not illustrated) may extend through the hat brim 10 such as generally at the junction between the hat brim 10 and the hat body 2, for example and without limitation.

An outer brim section 26*a* is defined between the outer brim wire 17*a* and the middle brim wire 17*b*. A middle brim section 26*b* is defined between the middle brim wire 17*b* and the inner brim wire 17*c*. An inner brim section 26*c* is defined between the inner brim wire 17*c* and the hat body 2. In some embodiments, as many as eight or more brim wires 17 may extend through the hat brim 10 in generally adjacent, spaced-apart relationship with respect to each other.

As illustrated in FIG. 2, each brim wire 17 may have a curvature which generally corresponds to the curvature of the rim 14 of the hat brim 10. Each brim wire 17 may have a middle wire portion 18 and end wire portions 19. In embodiments in which the hat brim 10 is crescent-shaped, the adjacent brim wires 17 may be disposed at their greatest spacing with respect to each other at the middle wire portions 18 of the brim wires 17. The positions of the middle wire portions 18 may generally correspond to the apex of the hat brim 10. Progressing outwardly from the middle wire portions 18, the brim wires 17 may converge and touch each other at the end wire portions 19. In some embodiments, the end wire portions 19 of the respective brim wires 17 may be disposed in spaced-apart relationship with respect to each other. The brim wires 17 may be positioned in various sequences or angles in the hat brim 10 such as to accommodate the shape of the hat brim 10. In some embodiments each brim wire 17 may be circular, with the multiple brim wires 17 in the hat brim 10 arranged in concentric relationship with respect to each other in the hat brim 10. Accordingly, each brim wire 17 may completely encircle the hat body 2.

Figure 1A:
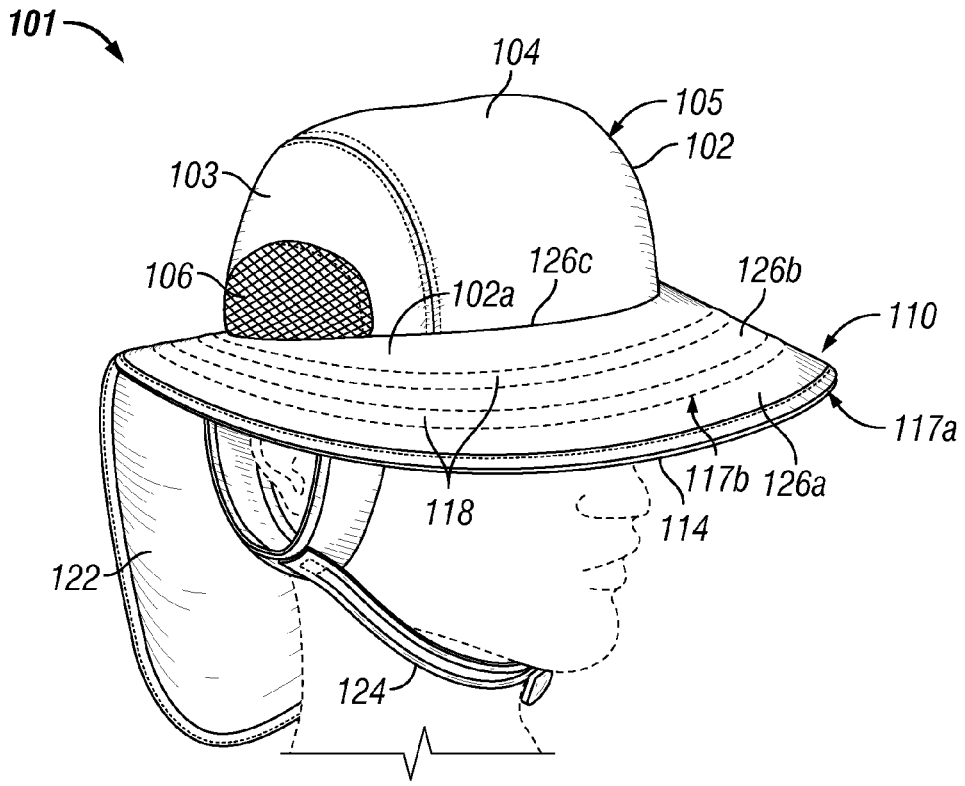
FIG. 1A is a front perspective view of an alternative illustrative embodiment of the wind and water hat.
Figure 2A:
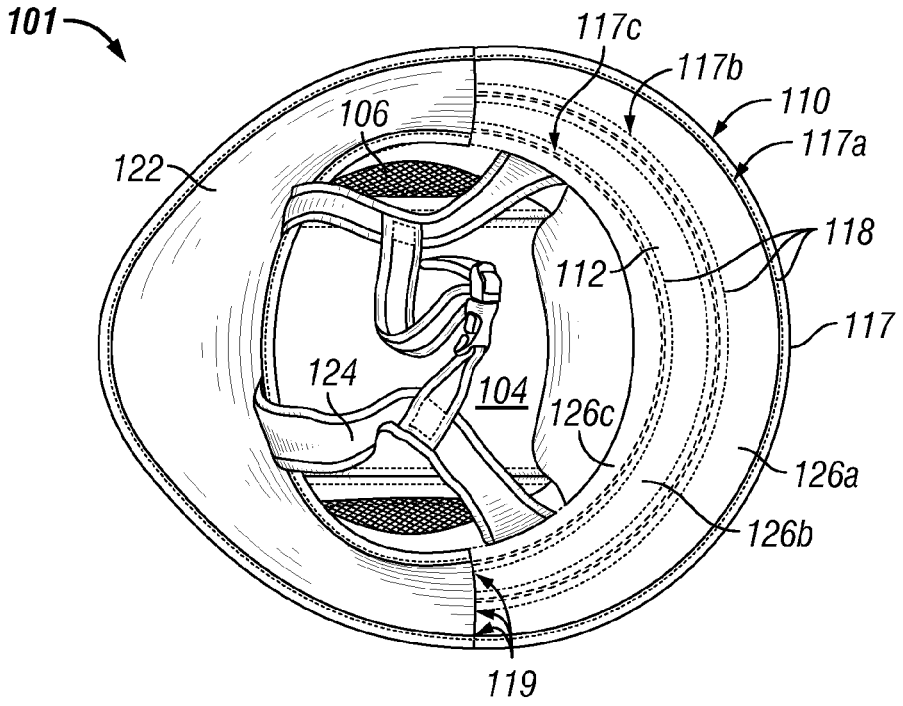
FIG. 2A is a bottom view of an illustrative embodiment of the wind and water hat of FIG. 1A.

In some embodiments as illustrated in FIGS. 1A and 2A, the wind and water hat 101 may include a hat body 102 which in some embodiments may have a pair of spaced-apart side portions 103 and a top portion 104 which extends between the side portions 103. A seam 105 may attach each side portion 103 to the top portion 104 of the hat body 102. In some embodiments, vent netting 106 may be provided in the hat body 102, such as in each side portion 103, for example and without limitation, for venting purposes. In some embodiments, a neck yoke 124 may extend from the hat body 102 for extension around the chin of the wearer.

A flexible hat brim 110 having a rim 114 extends from the hat body 102 at a brim/hat body junction 102*a*. The hat brim 110 may be sewn and/or otherwise attached to the hat body 102 according to the knowledge of those skilled in the art. As will be hereinafter described, the hat brim 110 may be capable of bending in a segmented or stepwise manner responsive to application of an external force such as wind or water to the hat brim 110. The segmented or stepwise bending of the hat brim 110 may at least partially deflect the external force which is applied to the hat brim 110 and prevent the hat body 102 from being inadvertently dislodged from the head of the wearer. At least one brim wire 117 is provided in the hat brim 110 between the rim 114 of the hat brim 110 and the brim/hat body junction 102*a*. The brim wire 117 divides the hat brim 110 into at least two brim sections 126. For example, brim wire 117*b* divides brim sections 126*a* and 126*b*. The brim wires 117 are positioned in the hat brim 110 in such a manner that the brim wires 117 hold the shape of the hat brim 110 until external forces (not illustrated) such as wind or rain, for example and without limitation, are applied against the hat brim 110.

The wind and water hat 101 includes an outer brim wire 117*a*; a middle brim wire 117*b*; and an inner brim wire 117*c* provided in the hat brim 110. The outer brim wire 117*a* may extend generally through or adjacent to the rim 114 of the hat brim 110. The middle brim wire 117*b* extends through the hat brim 110 in spaced-apart relationship with respect to the outer brim wire 117*a*. The inner brim wire 117*c* extends through the hat brim 110 in spaced-apart relationship with respect to the middle brim wire 117*b*.

An outer brim section 126*a* is defined between the outer brim wire 117*a* and the middle brim wire 117*b*. A middle brim section 126*b* is defined between the middle brim wire 117*b* and the inner brim wire 117*c*. An inner brim section 126*c* is defined between the inner brim wire 117*c* and the hat body 102.

As illustrated in FIG. 2A, each brim wire 117 may have a curvature which generally corresponds to the curvature of the rim 114 of the hat brim 110. Each brim wire 117 may have a middle wire portion 118 and end wire portions 119. In embodiments in which the hat brim 110 is crescent-shaped, the adjacent brim wires 117 may be disposed at their greatest spacing with respect to each other at the middle wire portions 118 of the brim wires 117. The positions of the middle wire portions 118 may generally correspond to the apex of the hat brim 110.

In some embodiments, hat brim 110 is initially deployed in a downwardly-sloped position, carried by the hat body 102. At least one generally flexible outer_brim wire 117*a* provided in the hat brim 110. At least one generally flexible inner brim wire 117*c* provided in the hat brim 110 in a spaced-apart relationship with respect to the outer brim wire 117*a*. The outer brim wire 117*a* and inner brim wire 117*c* are not connected to one another and operate independently of one another. In operation, when wind or other force is applied to hat brim 110, the downwardly-sloped hat brim 110 ratchets upwardly with respect to the outer brim wire 117*a* and inner brim wire 117*c* operating independently one from the other, responsive to the force applied to the hat brim 110. This operation provides a segmented or stepwise upward bending of the hat brim 110 in the direction of the force being applied to the hat brim 110.

Figure 6:
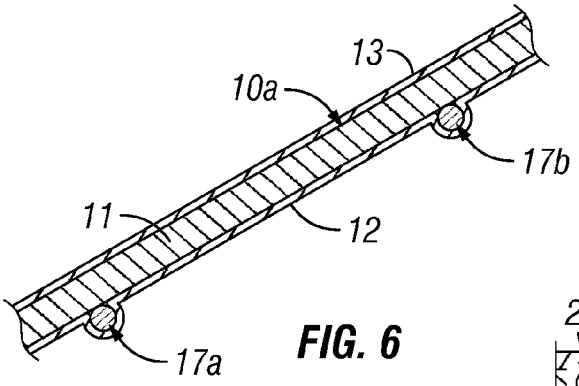
FIG. 6 is a cross-sectional view of a portion of the hat brim of an illustrative embodiment of the wind and water hat, with a pair of brim wires attached to a brim substrate and a brim cover attached to the brim substrate over the brim wires.
Figure 7:
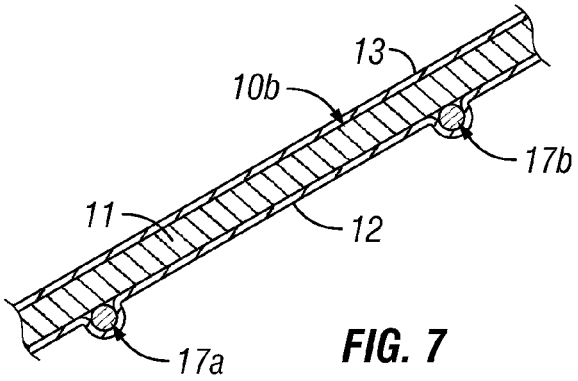
FIG. 7 is a cross-sectional view of a portion of the hat brim of an alternative illustrative embodiment of the wind and water hat, with a pair of wire channels provided between the brim cover and the brim substrate and a pair of brim wires extending through the wire channels, respectively.
Figure 7A:
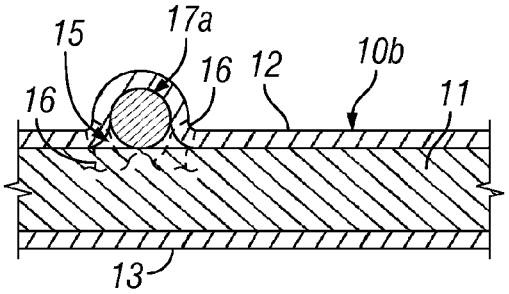
FIG. 7A is an enlarged sectional view of the brim wire of the wind and water hat illustrated in FIG. 7.

As illustrated in FIGS. 6-7A, in some embodiments the hat brim 10 may include a brim substrate 11. A first brim cover 12 and a second brim cover 13 may be provided on respective surfaces of the brim substrate 11. The brim substrate 11 of the hat brim 10 may be any suitable semi-rigid material having form and flexibility. Examples of materials which are suitable for construction of the hat brim 10 include closed cell foam, open cell foam, neoprene, interfacing, buckram and felt, for example and without limitation. Each of the first brim cover 12 and the second brim cover 13 may be a fabric material, for example and without limitation. In some embodiments, one brim cover 12 may be provided on a surface of the brim substrate 11. In some embodiments, the brim cover 12 may be laminated to the brim substrate 11 such that the brim wires 17 are held in place by a heat-sealed or welded sandwich of the brim substrate 11 and brim cover 12.

Figure 6A:
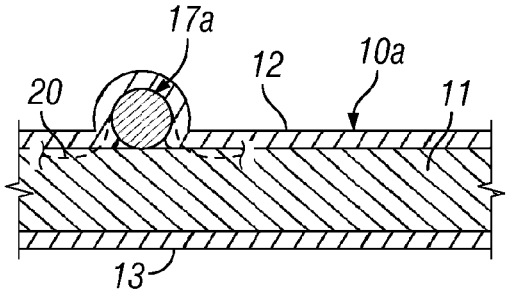
FIG. 6A is an enlarged sectional view of the brim wire of the wind and water hat illustrated in FIG. 6.

As illustrated in FIGS. 6 and 6A, in some embodiments of the wind and water hat 1, the hat brim 10*a* may be fabricated by initially attaching each brim wire 17 to the brim substrate 11. Each brim wire 17 may be attached to the lower surface (FIG. 6) of the brim substrate 11 or alternatively, to the upper surface (FIG. 6A) of the brim substrate 11. As illustrated in FIG. 6A, in some embodiments, each brim wire 17 may be attached to the brim substrate 11 via wire thread 20 using a zigzag sewing pattern. The brim substrate 11 with the brim wires 17 attached thereto may then be sandwiched between the first brim cover 12 and the second brim cover 13 and sewn and/or otherwise attached to the brim substrate 11. The fabricated hat brim 10*a* may then be attached to the hat body 2 via sewing and/or other suitable attachment technique known by those skilled in the art.

As illustrated in FIGS. 7 and 7A, in some embodiments of the wind and water hat 1, the hat brim 10*b* may be fabricated by attaching the first brim cover 12 to the brim substrate 11 via sewing and/or other suitable attachment technique known by those skilled in the art. Each brim wire 17 may be attached to the lower surface (FIG. 7) of the brim substrate 11 or alternatively, to the upper surface (FIG. 7A) of the brim substrate 11. As illustrated in FIG. 7A, wire channels 15 may be formed in the first brim cover 12 such as by sewing the first brim cover 12 to the brim substrate 11 using channel threads 16, for example and without limitation. The brim wires 17 may then be inserted or extended into the respective wire channels 15. The second brim cover 13 may be attached to the brim substrate 11 using sewing and/or other suitable attachment technique.

In typical application of the wind and water hat 1, the hat body 2 is placed on the head (not illustrated) of a wearer. In some embodiments, the hat body 2 may be secured to the head of the wearer by adjusting the size of the adjustment strap 7 (FIGS. 2-5). Additionally or alternatively, the chin strap 24 (FIGS. 1 and 3) or neck yoke 25 (FIGS. 4 and 5) may be placed and tightened around the chin (not illustrated) of the wearer. The wind and water hat 1 may be worn by a wearer as the wearer engages in active water sports such as surfing or water skiing, for example and without limitation.

The hat brim 10 may initially be deployed in the downwardly-sloped position illustrated in FIGS. 1-3 and in solid lines in FIG. 4. The brim wires 17 normally hold the shape of the hat brim 10 in the downwardly-sloped position. In the event that external forces (not illustrated) such as wind or rain, for example and without limitation, are applied against the hat brim 10 toward the hat body 2, as illustrated in FIGS. 4 and 5, the hat brim 10 may become deflected upwardly along the outer brim wire 17*a*, the middle brim wire 17*b* or the inner brim wire 17*c*. In the event that the strength of the external force is relatively small, the outer brim section 26*a* of the hat brim 10 may become deflected upwardly along the middle brim wire 17*b*, as indicated in phantom in FIG. 4, while the middle brim section 26*b* and the inner brim section 26*c* may remain in the downwardly-sloped position. In the event that the strength of the external force is relatively larger, both the outer brim section 26*a* and the middle brim section 26*b* may be deflected upwardly along the inner brim wire 17*c*, as indicated in phantom in FIG. 4. In the event that the strength of the external force is still greater, the outer brim section 26*a*; the middle brim section 26*b*; and the inner brim section 26*c* may be deflected upwardly along the innermost brim wire (not illustrated) at or adjacent to the junction between the hat brim 10 and the hat body 2, as illustrated in FIG. 5. Therefore, the hat brim 10 may sequentially yield in a stepwise or ratcheting manner to the external force which is applied against it from the rim 14 toward the innermost edge of the hat brim 10. The hat brim 10 may remain in the upwardly-deflected position until the wearer of the wind and water hat 1 returns the hat brim 10 to the downwardly-sloped position such as by pushing downwardly against the hat brim 10.

The progressive increase in the strength of the external force which is applied to the hat brim 10 may correspondingly increase the number of brim segments 26 which ratchet to the upwardly-deflected position. This ratcheting action of the hat brim 10 may prevent the wind and water hat 1 from being forcefully distorted or removed from the head of the wearer as may occur with hats having a rigid and inflexible brim. Under circumstances in which the wearer of the wind and water hat 1 engages in water sports, the hat brim 10 may ratchet upon impact with the water instead of the impact forcefully removing the wind and water hat 1 from the head of the wearer. The wind and water hat 1 may be worn in any of a variety of high wind and water impact conditions without compromising the benefits of the wearer's wearing a hat.

In some applications, a wearer may voluntarily ratchet the hat brim 10 to an upwardly-extending position illustrated in FIGS. 4 and 5 to enable enhanced visual exposure at times when peripheral or upward exposure to the wearer's eyes is needed. For instance sailors needing to inspect high mast conditions or surfers paddling on water in a prone position may partially or completely ratchet the hat brim 10 in the deflected position to allow increased vision that may otherwise be substantially unimpeded by the hat brim 10.

Figure 8:
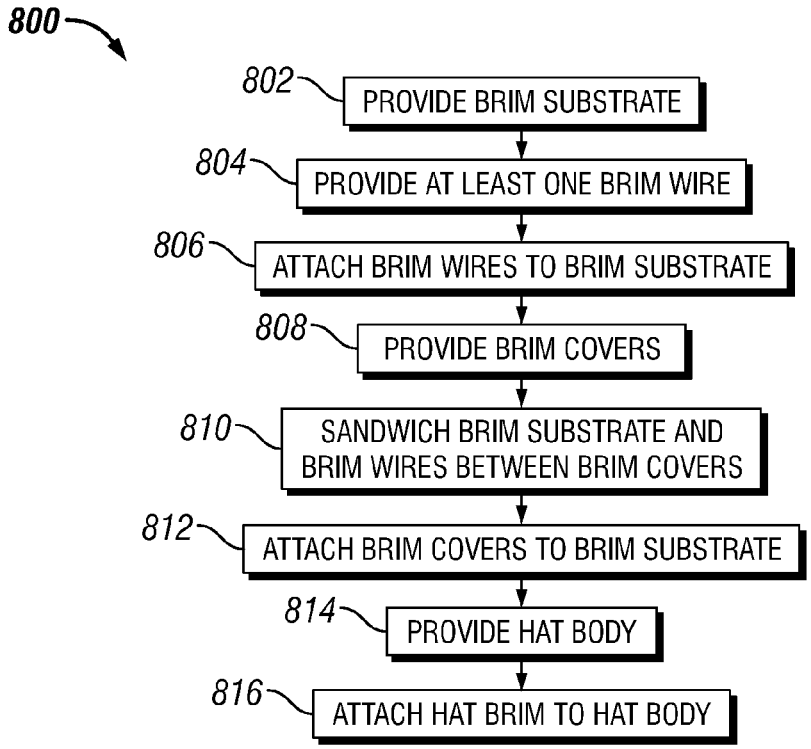
FIG. 8 is a flow diagram which illustrates an illustrative method of fabricating a wind and water hat.

Referring next to FIG. 8 of the drawings, a flow diagram 800 which illustrates an illustrative method of fabricating a wind and water hat is illustrated. In block 802, a brim substrate is provided. In block 804, at least one brim wire is provided. In block 806, the brim wires are attached to the brim substrate. In some embodiments, the brim wires may be sewn to the brim substrate. In block 808, brim covers are provided. In block 810, the brim substrate and the brim wires are sandwiched between the brim covers. In block 812, the brim covers are attached to the brim substrate. In block 814, a hat body is provided. In block 816, the hat brim is attached to the hat body.

Figure 9:
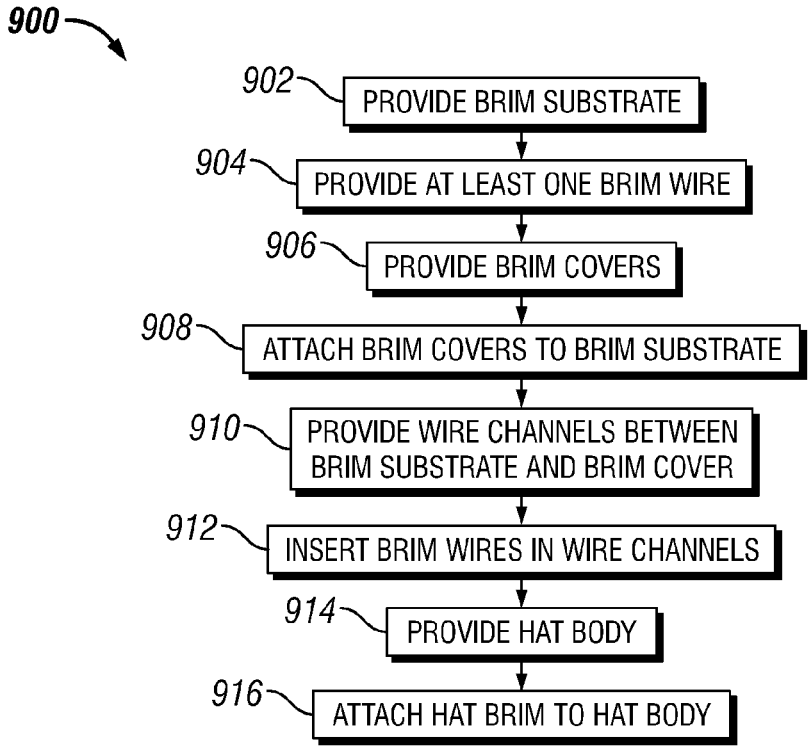
FIG. 9 is a flow diagram which illustrates an alternative illustrative method of fabricating a wind and water hat.

Referring next to FIG. 9 of the drawings, a flow diagram 900 which illustrates an alternative illustrative method of fabricating a wind and water hat is illustrated. In block 902, a brim substrate is provided. In block 904, at least one brim wire is provided. In block 906, brim covers are provided. In block 908, the brim covers are attached to the brim substrate. In block 910, wire channels are provided between the brim substrate and one of the brim covers. In block 912, the brim wires are inserted in the wire channels, respectively, to complete the hat brim. In block 914, a hat body is provided. In block 916, the hat brim is attached to the hat body.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A hat, comprising:

a hat body;

a hat brim coupled to the hat body at a body junction, the hat brim having at least three preset positions, a first preset position being where the hat brim is downwardly-sloped;

at least one generally flexible outer brim wire provided in the hat brim, the at least one generally flexible outer brim wire spaced from the body junction;

at least one generally flexible inner brim wire provided in the hat brim in a spaced-apart relationship with respect to the outer brim wire, the at least one generally flexible inner brim wire spaced from the body junction;

a semi-rigid continuous brim substrate provided in the hat brim and attached to the at least one generally flexible outer brim wire and the at least one generally flexible inner brim wire, each of the outer and inner brim wires being sandwiched between the brim substrate and a brim cover;

wherein the outer and inner brim wires are not connected to one another and divide the hat brim into a plurality of brim sections each of the plurality of brim sections comprising a portion of the semi-rigid continuous brim substrate, the at least three preset positions further including second and third positions comprising ratcheted positions of the hat brim, the second and third ratcheted positions each comprising a segmented or stepwise deflection of one of the plurality of brim sections relative to another of the plurality of brim sections;

each of the at least one generally flexible outer brim wire and the at least one generally flexible inner brim wire having a middle wire portion and a first end wire portion extending from the middle wire portion and a complementary second end wire portion extending from the middle wire portion, for each outer brim wire, the first end wire portion of that outer brim wire terminating at a respective first position and the complementary second end wire portion of that outer brim wire terminating at a respective complementary second position, each respective first position being spaced from the respective complementary second position, and for each inner brim wire, the first end wire portion of that inner brim wire terminating at a respective third position and the complementary second end wire portion of that inner brim wire terminating at a respective complementary fourth position, each respective third position being spaced from the respective complementary fourth position, and each of the first and second end wire portions of each of the inner and outer brim wires terminating into one or more of a fabric material and the brim substrate, the at least one generally flexible inner brim wire being spaced from the body junction by a first distance at the middle wire portion and being spaced from the body junction by a second distance at the first and second end wire portions, the first distance being greater than the second distance, and the at least one generally flexible outer brim wire being spaced from the at least one generally flexible inner brim wire by a third distance at the middle wire portion and spaced from the at least one generally flexible inner brim wire by a fourth distance at the first and second end wire portions, the third distance being greater than the fourth distance; and wherein the downwardly-sloped hat brim is configured to ratchet upwardly with respect to the outer and inner brim wires operating independently one from the other, responsive to force applied to the hat brim thereby providing segmented or stepwise upward bending of the hat brim in a direction of the force being applied to the hat brim.

2. The hat of claim 1 wherein the hat body comprises a cap or a visor, and wherein the stepwise upward bending of the hat brim provides ratcheting to the at least three preset positions, the hat brim having one or more of the at least three preset positions responsive to ratcheting upwardly via the stepwise upward bending.

3. The hat of claim 1 further comprising a neck shield carried by the hat body.

4. The hat of claim 1 further comprising a chin strap carried by the hat body.

5. The hat of claim 1 wherein one or more of the at least one generally flexible outer brim wire and the at least one generally flexible inner brim wire comprises a flexible synthetic material.

6. The hat of claim 5 wherein the flexible synthetic material is polyester, polypropylene or nylon.

7. The hat of claim 1 wherein one or more of the at least one generally flexible outer brim wire and the at least one generally flexible inner brim wire comprises a plurality of generally flexible brim wires provided in the hat brim.

8. The hat of claim 1, wherein the hat brim comprises a first brim cover and a second brim cover provided on opposing surfaces of the brim substrate, and where only the brim substrate and one or more of the first brim cover and the second brim cover are positioned between adjacent ones of the at least one generally flexible outer brim wire and the at least one generally flexible inner brim wire.

9. A hat, comprising:

a hat body;

a hat brim having a rim carried by the hat body and having a semi-rigid brim substrate and at least one brim cover provided on the brim substrate, at least a portion of a first surface of the brim substrate being in contact with at least a portion of a second surface of the at least one brim cover, the hat brim having a plurality of preset positions, the plurality of preset positions including a downwardly-sloped position of the hat brim;

at least one generally flexible outer brim wire carried by the brim substrate of the hat brim, extending generally through or adjacent to the rim and disposed between the first surface of the brim substrate and the second surface of the at least one brim cover;

at least one generally flexible middle brim wire extending through the hat brim in a spaced-apart relationship with respect to the outer brim wire and disposed between the first surface of the brim substrate and the second surface of the at least one brim cover, the plurality of preset positions of the hat brim further including a first ratcheted position in which an outer brim section formed between the at least one generally flexible outer brim wire and the at least one generally flexible middle brim wire is deflected upwardly along the at least one generally flexible middle brim wire;

at least one generally flexible inner brim wire provided in the hat brim in a spaced-apart relationship with respect to the middle brim wire and the outer brim wire and disposed between the first surface of the brim substrate and the second surface of the at least one brim cover, the plurality of preset positions of the hat brim further including a second ratcheted position in which a middle brim section formed between the at least one generally flexible middle brim wire and the at least one generally flexible inner brim wire is deflected upwardly along the at least one generally flexible inner brim wire, wherein the outer, middle, and inner brim wires are not connected to one another and are configured to operate independently of one another, the brim substrate being continuous between the middle and outer brim sections that are divided by the middle brim wire;

each of the at least one generally flexible outer brim wire, the at least one generally flexible middle brim wire, and the at least one generally flexible inner brim wire having a middle wire portion and terminal end wire portions extending from the middle wire portion;

wherein adjacent ones of the at least one generally flexible outer brim wire, the at least one generally flexible middle brim wire, and the at least one generally flexible inner brim wire are disposed at their greatest spacing with respect to each other at the middle wire portion at a front of the hat, and wherein each of the outer brim section and the middle brim section are crescent-shaped and have a width at the front of the hat that is greater than a width at sides of the hat, the outer brim section and the middle brim section each having terminating ends that are spaced from one another, where, for each brim wire, each terminating end is spaced from a complementary terminating end of that brim wire; and wherein the at least one generally flexible outer brim wire, the at least one generally flexible middle brim wire, and the at least one generally flexible inner brim wire converge toward each other from the middle wire portion to the terminal end wire portions.

10. The hat of claim 9 wherein the at least one generally flexible outer brim wire, the at least one generally flexible middle brim wire, and the at least one generally flexible inner brim wire are interposed between the brim substrate and the at least one brim cover.

11. The hat of claim 10 wherein the at least one generally flexible outer brim wire, the at least one generally flexible middle brim wire, and the at least one generally flexible inner brim wire are attached to the brim substrate.

12. The hat of claim 10 further comprising a plurality of wire channels provided between the brim substrate and the at least one brim cover and wherein the at least one generally flexible outer brim wire, the at least one generally flexible middle brim wire, and the at least one generally flexible inner brim wire extend through the plurality of wire channels.

13. The hat of claim 9 wherein the brim substrate is closed cell foam or open cell foam.

14. The hat of claim 9 wherein the at least one brim wire comprises a flexible synthetic material.

15. The hat of claim 14 wherein the flexible synthetic material is polyester, polypropylene or nylon.

16. The hat of claim 9 wherein the at least one generally flexible outer brim wire, the at least one generally flexible middle brim wire, and the at least one generally flexible inner brim wire each comprises a plurality of generally parallel, spaced-apart, generally flexible brim wires provided in the hat brim.

17. A hat, comprising:

a hat body;

a hat brim having a plurality of preset positions including a downwardly-sloped position, the hat brim coupled to the hat body via a body junction;

at least one generally flexible outer brim wire provided in the hat brim;

at least one generally flexible inner brim wire provided in the hat brim in a spaced-apart relationship with respect to the outer brim wire;

a continuous, semi-rigid brim substrate provided in the hat brim, the at least one outer brim wire and the at least one inner brim wire being positioned between the brim substrate and a brim cover, the brim cover being attached to the brim substrate over the at least one outer brim wire and the at least one inner brim wire; and a flexible neck shield carried by the hat body, wherein the outer and inner brim wires are not connected to one another and operate independently of one another, each of the at least one generally flexible outer brim wire and the at least one generally flexible inner brim wire having a middle wire portion and end wire portions extending from the middle wire portion and each of the end wire portions terminating at a neck shield junction where the neck shield extends from the hat body, where, for each brim wire, each end wire portion terminates at an opposing side of the neck shield junction than a complementary end wire portion of that brim wire, a position of the middle wire portion located at an apex of the hat brim opposite the neck shield, and the neck shield extending from a rear edge of the hat body and configured to cover at least a portion of a back of a neck of a wearer of the hat, and wherein adjacent ones of the at least one generally flexible outer brim wire and the at least one generally flexible inner brim wire are disposed at their greatest spacing with respect to each other at the middle wire portion; each of the adjacent ones of the at least one generally flexible outer brim wire together forming crescent-shaped regions therebetween, the crescent-shaped regions terminating at one or more of the body junction and the neck shield.

18. The hat of claim 17, wherein the plurality of preset positions of the hat brim includes one or more ratcheting positions where at least one of the crescent-shaped regions has a deflected position relative to at least another one of the crescent-shaped regions via stepwise bending of the hat brim.

19. The hat of claim 18, wherein the plurality of preset positions includes at least three preset positions.

* * * * *